US005308945A

United States Patent [19]

VanHandel et al.

[11] Patent Number: 5,308,945

[45] Date of Patent: May 3, 1994

[54] MICROWAVE INTERACTIVE PRINTABLE COATINGS

[75] Inventors: Gerald J. VanHandel; Paul J. Ruthven, both of Neenah; Scott W. Middleton, Appleton, all of Wis.

[73] Assignee: James River Corporation, Richmond, Va.

[21] Appl. No.: 580,577

[22] Filed: Sep. 11, 1990

Related U.S. Application Data

[60] Continuation of Ser. No. 196,797, May 17, 1988, abandoned, which is a division of Ser. No. 839,949, Mar. 17, 1986, abandoned.

[51] Int. Cl.[5] ..... H05B 6/80

[52] U.S. Cl. ..... 219/730; 219/759; 426/107; 426/241; 426/243; 126/390; 99/DIG. 14

[58] Field of Search ..... 219/10.55 E, 10.55 F, 219/10.55 R, 10.55 M; 426/107, 111, 113, 127, 234, 243, 241; 126/390; 99/DIG. 14, 451; 427/383.1, 126.1

[56] References Cited

U.S. PATENT DOCUMENTS

| | | | |
|---|---|---|---|
| 3,302,632 | 2/1967 | Fichtner | 219/10.55 E |
| 3,353,968 | 11/1967 | Krajewski | 219/10.55 E |
| 3,865,301 | 2/1975 | Pothier et al. | 219/10.55 E |
| 4,230,924 | 10/1980 | Brastad et al. | 219/10.55 E |
| 4,267,420 | 5/1981 | Brastad | 219/10.55 E |
| 4,518,651 | 5/1985 | Wolf, Jr. | 219/10.55 E |
| 4,612,431 | 9/1986 | Brown | 219/10.55 E |
| 4,640,838 | 2/1987 | Isakson | 219/10.55 E |
| 4,641,005 | 2/1987 | Seiferth | 219/10.55 E |
| 4,656,325 | 4/1987 | Keefer | 219/10.55 E |
| 4,661,671 | 4/1987 | Maroszek | 219/10.55 E |
| 4,662,969 | 5/1987 | Wang et al. | 219/10.55 R |
| 4,676,857 | 6/1987 | Scharr et al. | 219/10.55 EX |
| 4,751,358 | 6/1988 | Durand | 426/243 |
| 4,763,790 | 8/1988 | McGeehins | 219/10.55 E |
| 4,866,232 | 9/1989 | Stone | 219/10.55 E |
| 4,876,423 | 10/1989 | Tighe et al. | 219/10.55 E |

*Primary Examiner*—Philip H. Leung

*Attorney, Agent, or Firm*—Finnegan, Henderson, Farabow, Garrett, Dunner

[57] ABSTRACT

A microwave susceptor package such as a food package is disclosed which contains a microwave reactive material comprising a support material and a microwave interactive coating on the support material. The support material is selected from microwave transparent and thermally stable substrates whereas the microwave interactive coating comprises metal particles in an ink-like substance that may be printed onto the substrate such as a portion of the substrate.

5 Claims, 8 Drawing Sheets

MICROWAVE INTERACTIVE PRINTABLE COATINGS

This is a continuation of U.S. Ser. No. 07/196,797, filed May 17, 1988, abandoned, which is a divisional of U.S. Ser. No. 06/839,949, filed Mar. 17, 1986, abandoned.

BACKGROUND

This invention relates to microwave interactive materials. It also relates to microwave interactive coatings.

The cooking of food and heating of substances with microwave radiation has become increasingly popular and important in recent years because of its speed, economy, and low power consumption. With food products, however, microwave heating has drawbacks. One of the major drawbacks is the inability to brown or sear the food product to make it similar in taste and appearance to conventionally cooked food.

Several methods have been attempted in the prior art to overcome the browning problem. One such method for browning food and other materials involves the use of a metalized coating on paperboard. The prior art process for manufacturing this coated paperboard required several steps.

First, metal particles are vacuum deposited onto a film, preferably a polyester film. The film is then laminated onto the paper. The thus metalized paper, typically, must then be positioned onto a particular part of the food package, requiring a relatively complicated windowing operation.

The windowing operation requires that the metallized paper be slit before entering the process. The windowing process also can only create rectangular shaped laminates.

Besides the complexity of the prior art process, there are several other disadvantages. With vacuum deposition, it is difficult, if not impractical, to develop a specific pattern or shape to the coating applied which would be useful for controlling the heating of the food product. It is also difficult in the deposition process to vary the coating formulation or coating thickness in localized areas of the film to meet different heating requirements. This is particularly important when heating different foods together in a microwave oven.

SUMMARY OF THE INVENTION

The present invention provides a microwave interactive coating which is capable of being printed on a substrate. This coating overcomes the problems inherent in vacuum deposited metal coatings because the coatings can be printed exactly where they are required. Furthermore, coating patterns, coating formulations and coating thicknesses can all be varied using conventional printing processes. A printing process also allows the use of materials besides metals as microwave reactive materials, as well as providing the possibility for a wide range of heating temperatures and a wide variety of applications.

The present invention, then, provides a microwave interactive printable coating composition comprising a microwave reactive material selected from a conductor or semiconductor, a dielectric, or a ferromagnetic; and a binder.

The invention also provides a microwave interactive coated substrate comprising a substrate coated with a microwave interactive printable coating composition comprising a microwave reactive material selected from a conductor or semiconductor, a dielectric, or a ferromagnetic; and a binder.

In a preferred embodiment of this aspect of the invention, the microwave interactive printable coating is coated onto a film which is further laminated to a microwave transparent substrate.

In another embodiment, this invention provides a method of manufacturing a microwave interactive coated substrate comprising coating a substrate using a conventional printing process with a microwave interactive printable coating composition comprising a microwave reactive material selected from a conductor or semiconductor, a dielectric, or a ferromagentic; and a binder.

DETAILED DESCRIPTION OF THE INVENTION

Figure 1:
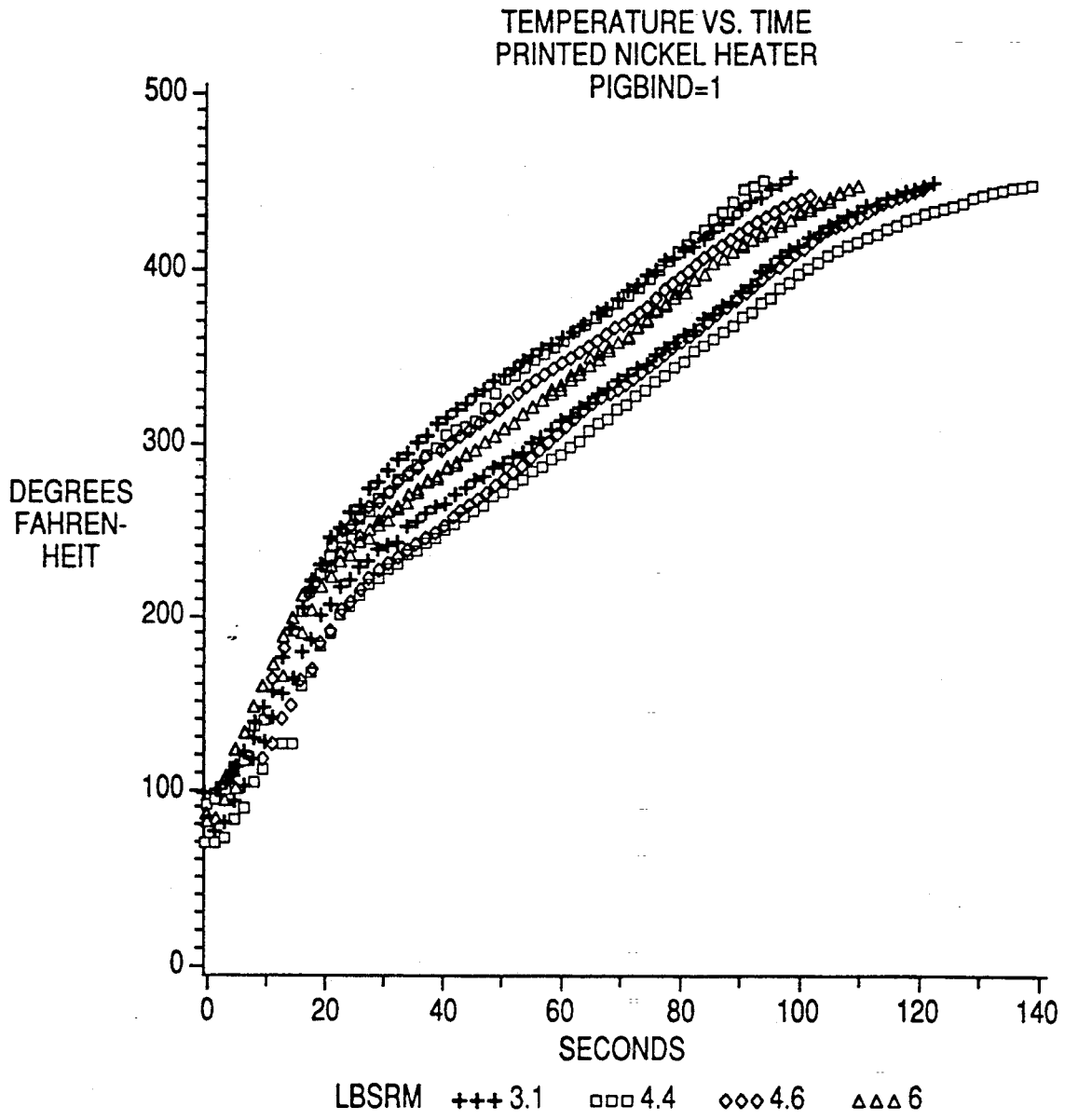
FIGS. 1–8 are heating curves in degrees Fahrenheit vs. seconds wherein the family of curves on each figure corresponds to a range of coating weights in lbs/rm, (pounds per ream) as noted at the bottom of the figures.
Figure 2:
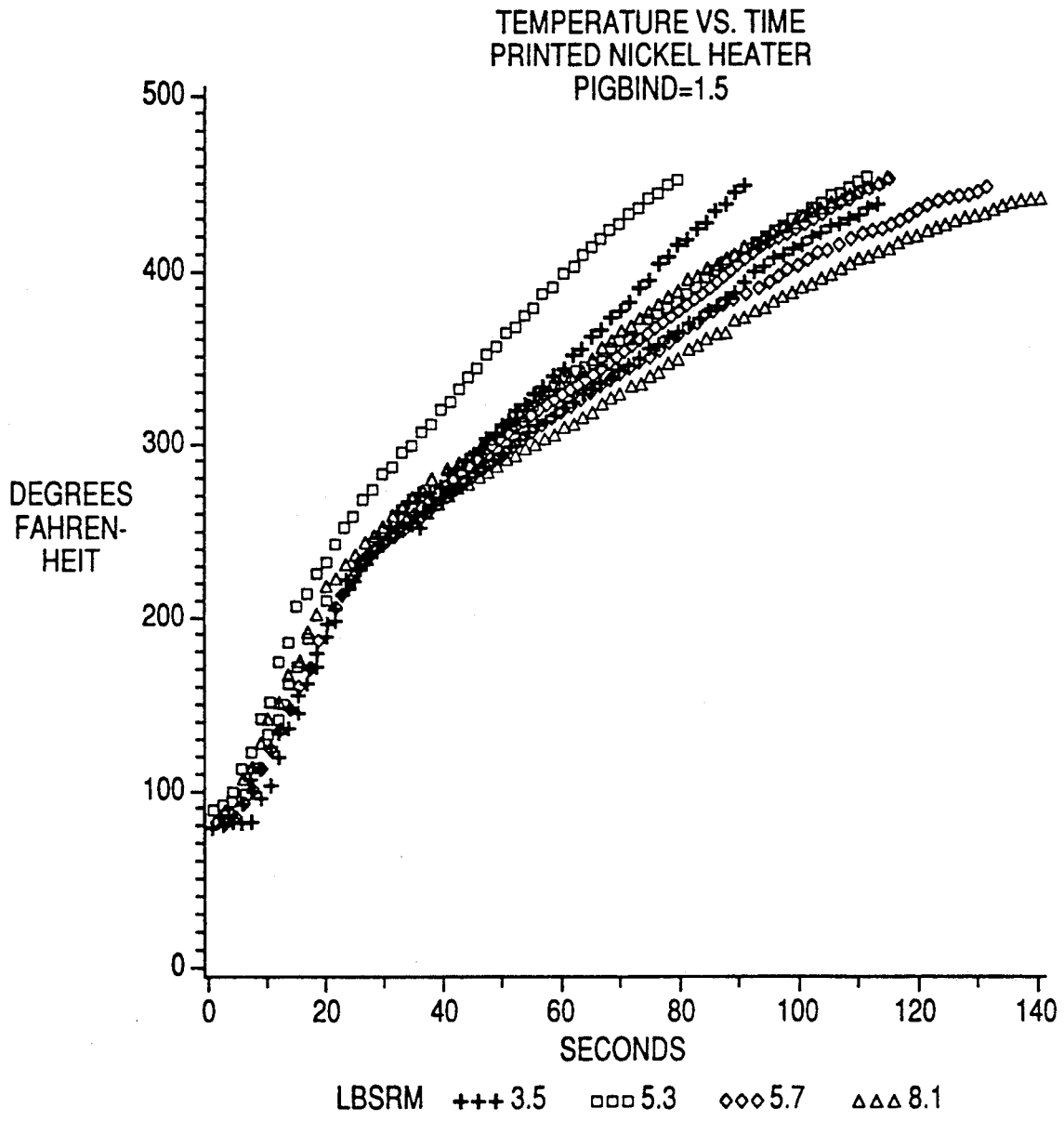

Microwave reactive materials (MRM) are capable of converting microwave energy to heat. This is accomplished using either the conductive or semiconductive properties, dielectric properties, or ferromagnetic properties of the microwave reactive materials. The materials having these properties will hereafter be referred to as conductors, semiconductors, dielectrics or ferromagnetics.

The microwave reactive materials included within the scope of this invention include any material which has suitable conductive or semiconductive, dielectric or ferromagnetic properties so that the material is capable of converting microwave radiation to heat energy. The materials can have any one of the above properties or can have a combination of the above properties. Furthermore, the microwave reactive material can have different of the above properties depending upon the coating formulation, the type of binder used, or the microwave reactive material's particle size and shape. Furthermore the properties of the substrate on which the material is coated, such as the orientation, heatset temperature, and melting point, as well as the adhesion between the coating and the substrate will affect the reactiveness of the materials to microwave energy.

The type and amount of microwave reactive materials used in the coating composition generally determines the degree of interaction with the microwaves and hence the amount of heating. In a preferred embodiment, where the material used is conductive, the amount of heat generated is a function of the product of the conductivity of the material and the thickness of the material.

In one preferred aspect of this embodiment, when the microwave reactive material is carbon, the microwave reactive material combined with binder will preferably have a resistivity ranging from 50 ohms per square to 10,000 ohms per square.

Generally any metal, alloy, oxide or any ferrite material which has microwave reactive properties as described above can be used as a microwave reactive material. Microwave reactive materials preferred in this invention include suitable compositions comprising aluminum, iron, nickel, copper, silver, carbon, stainless steel, nichrome, magnetite, zinc, tin, iron, tungsten, titanium and the like. The materials can be used in a powder form, flake form or any other finely divided form which can be suitably used in printing processes.

The microwave reactive materials can be used individually or can be used in combination with other microwave reactive materials.

In the preferred embodiment of the invention, the microwave reactive material will be suitable for food packaging. Alternatively, the microwave reactive material will be separated from the food by a film or other protective means.

It is preferred that the microwave reactive materials demonstrate rapid heating to a desired temperature, with subsequent leveling off of the temperature, without arcing during the material's exposure to microwave radiation. The temperature at which the microwave reactive material levels off is hereinafter referred to as the operating temperature. Generally, the microwave reactive material will operate at a temperature ranging from about 275° to about 480° F.

The microwave reactive material is combined with a binder to form a coating composition. The binder used in this invention can comprise any aqueous or hydrocarbon dispersed or dissolved material that can be used in a printing process. The binder must have good thermal resistance and suffer little or no degradation at the temperatures generated by the microwave reactive material. It must also have an adhesive ability which will allow it to adhere to the substrate.

In one preferred embodiment of this invention, an important aspect is that the microwave reactive material coated substrate must shrink during the heating process at a controlled rate so that the temperature of the coating rises rapidly and then remains at a constant level. In this embodiment, it is important that the binders chosen be adhesive enough to bind the microwave reactive material to the substrate during the treatment with microwave energy.

Preferred binders for the present invention can be selected from water based emulsion polymers such as acrylic emulsions; latexes, such as casein/neoprenes; or any hydrocarbon solvent system adhesives known in the printing art or any other laminating adhesives.

The binder and the microwave reactive material are generally combined in a suitable ratio such that the microwave reactive material, in the form of a thin film, can convert the microwave radiation to heat to raise the temperature of a food item placed thereon, yet still have sufficient binder to be printable and to adhere to the film. There should also be sufficient binder present to prevent arcing of the microwave reactive material.

Generally, the ratio of the microwave reactive material to binder, on a solids basis, will depend upon the microwave reactive material and binder chosen. In a preferred embodiment, where the microwave reactive material is nickel and the binder is an acrylic emulsion, the microwave reactive material to binder ratio, on a weight basis, should be about 2:1 or higher.

Other materials can be included in the coating composition, such as surfactants, dispersion aids and other conventional additives for printing compositions.

The coating can be applied using conventional printing processes such as rotogravure, flexography and lithography. After the coating composition has been applied it can be dried using conventional printing ovens normally provided in a printing process.

Generally, any amount of coating can be used in the present invention. The amount of heat generated will vary according to the amount and type of coating applied to the substrate. In a preferred embodiment, when the coating material is nickel, the amount of coating will range from about 3 to about 11 pounds per 3000 $ft.^2$ ream.

The coating composition can generally be coated upon any substrate, such as paper or paperboard or any suitable film material. Typically any substrate which is microwave radiation transparent, or otherwise can be used in a microwave process can have applied to it the microwave reactive coating of the present invention.

A desirable feature for the microwave reactive coated substrates is that the substrate should either shrink during the heating process at a controlled rate or in some other manner the interparticle network of the coating should be disrupted so that the temperature of the coating rises rapidly and then remains at a constant level.

In a preferred embodiment of this invention, the coating composition is printed onto an oriented film. The film can be selected from any known films such as polyesters, nylons, polycarbonates and the like. The film used generally should be shrinkable at the operating temperatures of the microwave reactive material but any film material which shrinks can be used. The film must also have a melting point above the operating temperature of the microwave reactive material. A particularly preferred class of films include oriented polyester films such as Mylar®.

The thus coated film, in the preferred embodiment of this invention, is then applied to a microwave transparent substrate. The substrate, preferably, is also dimensionally stable at the operating temperature of the microwave reactive material. Typical substrates include paper and paperboard.

The film is attached to the substrate using conventional adhesives. The adhesives used must be able to withstand heating temperatures within the operating range of the microwave reactive material. The adhesive must also be able to control the rate at which the film shrinks.

Typical adhesive used in this invention include the materials used in the coating composition as the binder.

The advantages of using this process to provide a microwave interactive coating to a paper or paperboard is that the printing process provides increased flexibility. Patterns can be made in the coating and can be applied using conventional printing techniques to precise locations on the film. Furthermore different coating thickness can be applied simultaneously where foods requiring different levels of heating are utilized in the same paperboard container. Printing processes require fewer steps, are more continuous processes and further avoid the problems of smoothness, outgassing and optimum control required of the metalization process.

The following experimental results demonstrate particular embodiments of this invention but are not intended to limit the scope of this invention. This invention is only limited by the claims following these examples.

EXAMPLES

A study of the effects on microwave interactive coated substrates of coating weight and microwave reactive material (MRM) to binder ratio (by weight) was performed as follows.

Nickel coatings were prepared with Alcan 756 nickel flake (average particle size=7 microns) and Dexter/-

Midland R42-104A acrylic emulsion (35% solids by weight). The components were mixed with a Tekmar high intensity disperser. Viscosity of the coatings was adjusted to approximately 100 cps at 25° C. by addition of concentrated ammonium hydroxide ($NH_4OH$) dropwise during the dispersing process. Percent solids and viscosities of the coatings at the various MRM/binder ratios are listed below:

| (MRM)/Binder | Percent Solids | Viscosity* |
|---|---|---|
| 1.0 | 52.9% | 87 cps |
| 1.5 | 58.4 | 107 |
| 2.0 | 62.8 | 107 |
| 2.5 | 66.3 | 107 |
| 3.0 | 69.2 | 95 |

*Viscosity measured with a #4 shell cup.

A Geiger rotogravure press was used to apply the coatings to polyester films (Dupont 48LBT and a Bemis film). The Geiger is a single station, hand-fed press that applies a 3½ inch wide band of coating to the film. Coating weight was varied by using different etched cylinders to apply the coatings (85 line/inch, 100 line/inch, 120 line/inch, 175 line/inch). The coatings were dried by passing the coated films in front of a hot air gun several times.

The coated films were then laminated, coated side down, to a Potlatch milk container board. Dexter/Midland R42-104A adhesive was applied to the board with a #12 drawdown rod. The coated film was laid on the wet adhesive and was nipped to the board with a rubber roller. The laminate was either dried very briefly in a 105° C. oven or was allowed to air dry overnight.

To test the heating performance of the samples, 2"×4" pieces were taped to the backs of paper plates (6¾" diameter). The inverted paper plate (with the sample taped on top of it) was placed in a 600 watt Litton 460 microwave oven (the plate raised the sample ½ inch off the floor of the oven). A Luxtron fluoroptic temperature sensing probe was taped to the center of the sample. The sample was allowed to heat in the oven at full power without a competing load for 3 minutes. The data obtained from the temperature probe was used to produce time-temperature plots. Temperature limitations of the probe required its removal from the sample at 450 degrees F. Temperature of the sample for the remainder of the 3 minute heating period was monitored with a Hughes infrared camera.

A similar study was performed on Electrodag 36, a graphite coating from Acheson Colloids. The binder, in this case, is an acrylic-silicone emulsion. Its viscosity was reduced to 95 cps at 25° C. by adding water. Solids of the diluted coating was 32%.

Discussion of FIGS. 1-8

All figures are heating curves in degrees Fahrenheit vs. seconds. FIGS. 1-5 are for nickel heaters with pigment (MRM) to binder ratios of 1, 1.5, 2.0, 2.5 and 3.0 respectively. The family of curves on each figure corresponds to a range of coating weights in lbs/rm, (pounds per ream) as noted at the bottom of the figures.

Two samples of each pigment (MRM) to binder ratio and coating weight combination were tested. Reproducibility was generally good at MRM/binder ratios of 2.0 or greater.

Figure 3:
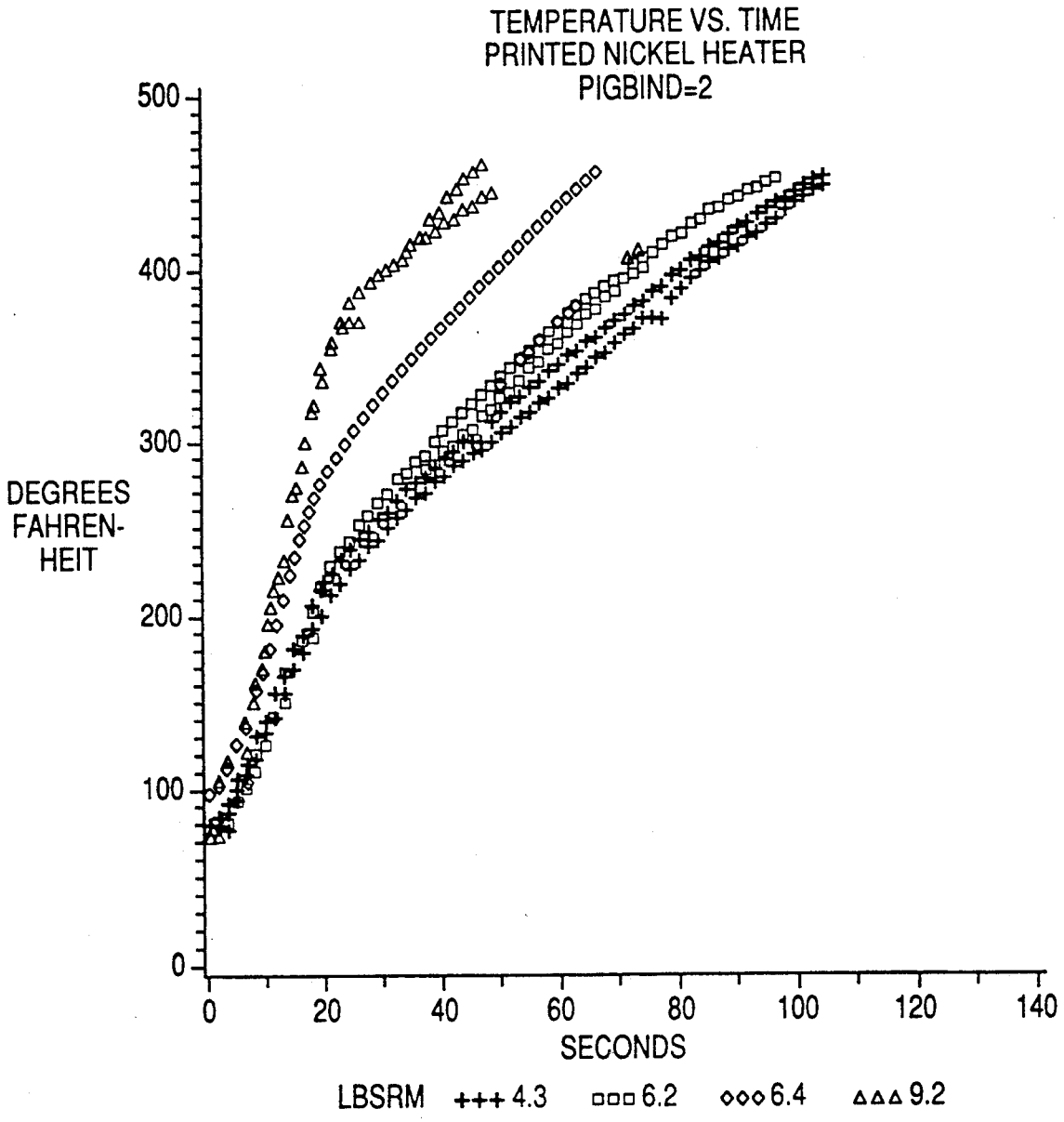
Figure 4:
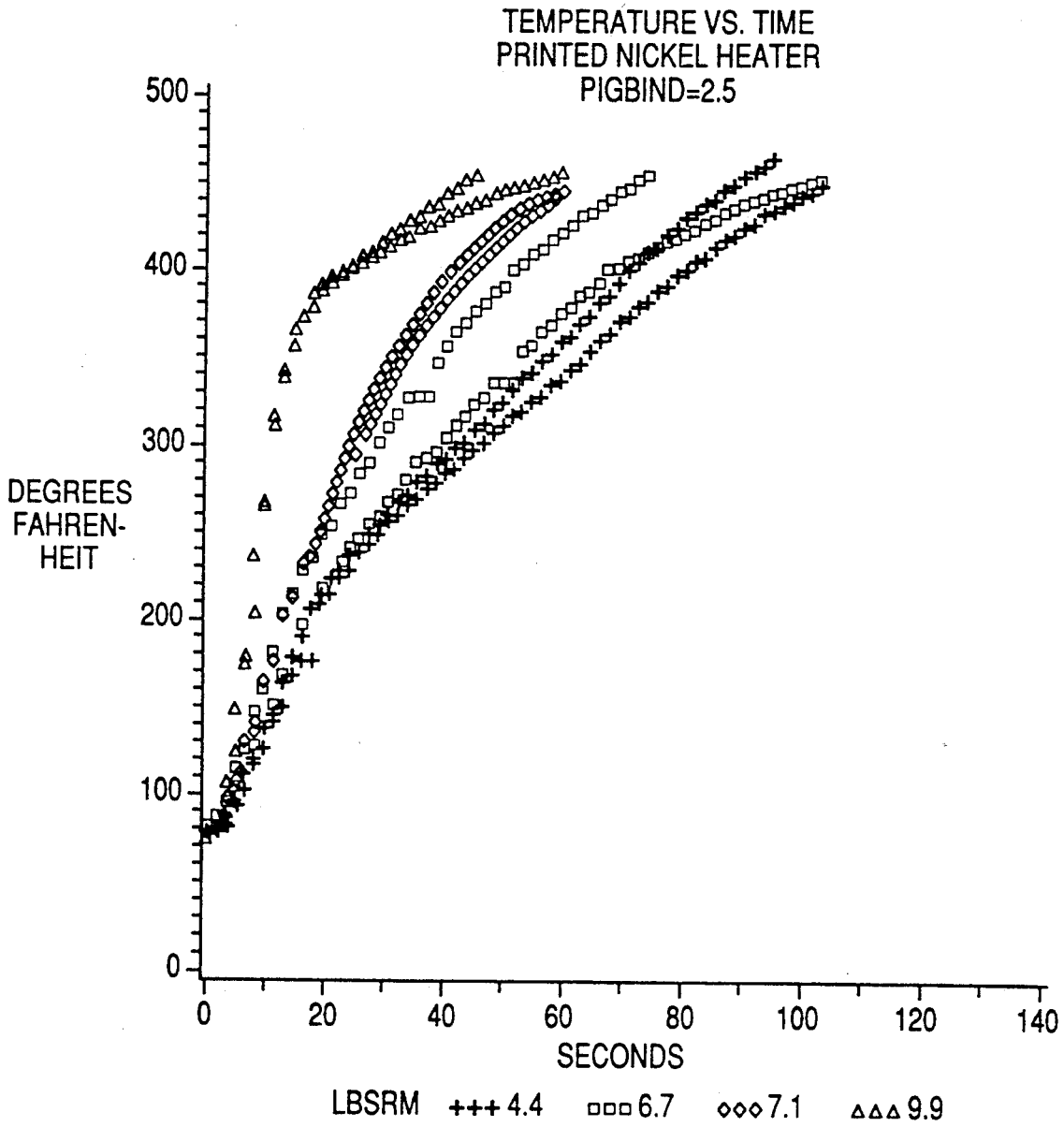
Figure 5:
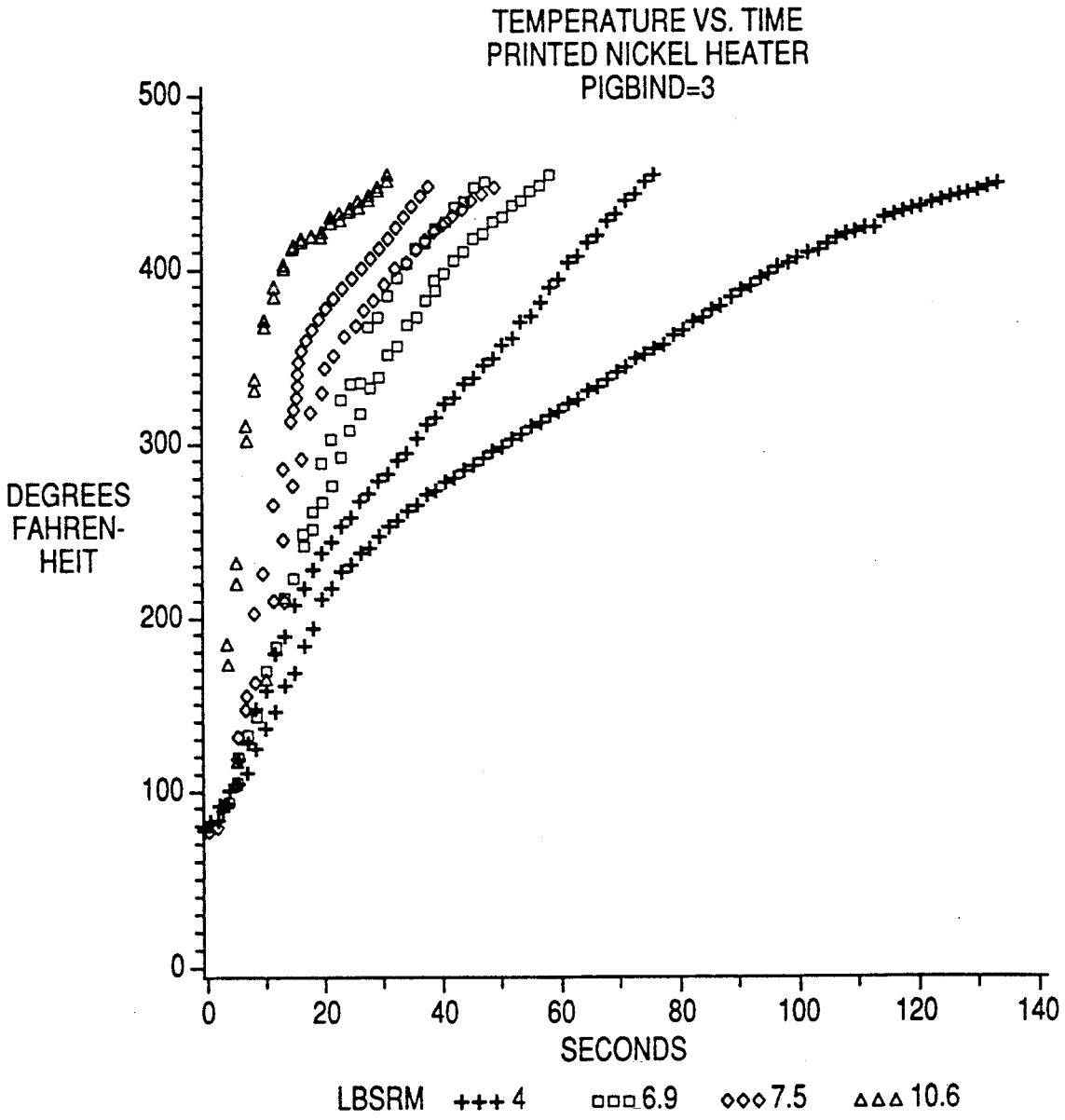

FIGS. 3-5 indicate that heating rate increases with increasing coating weight at a given MRM/binder ratio. There is also indication that the heating rate increases with increasing MRM/binder ratio at a given coating weight.

Figure 6:
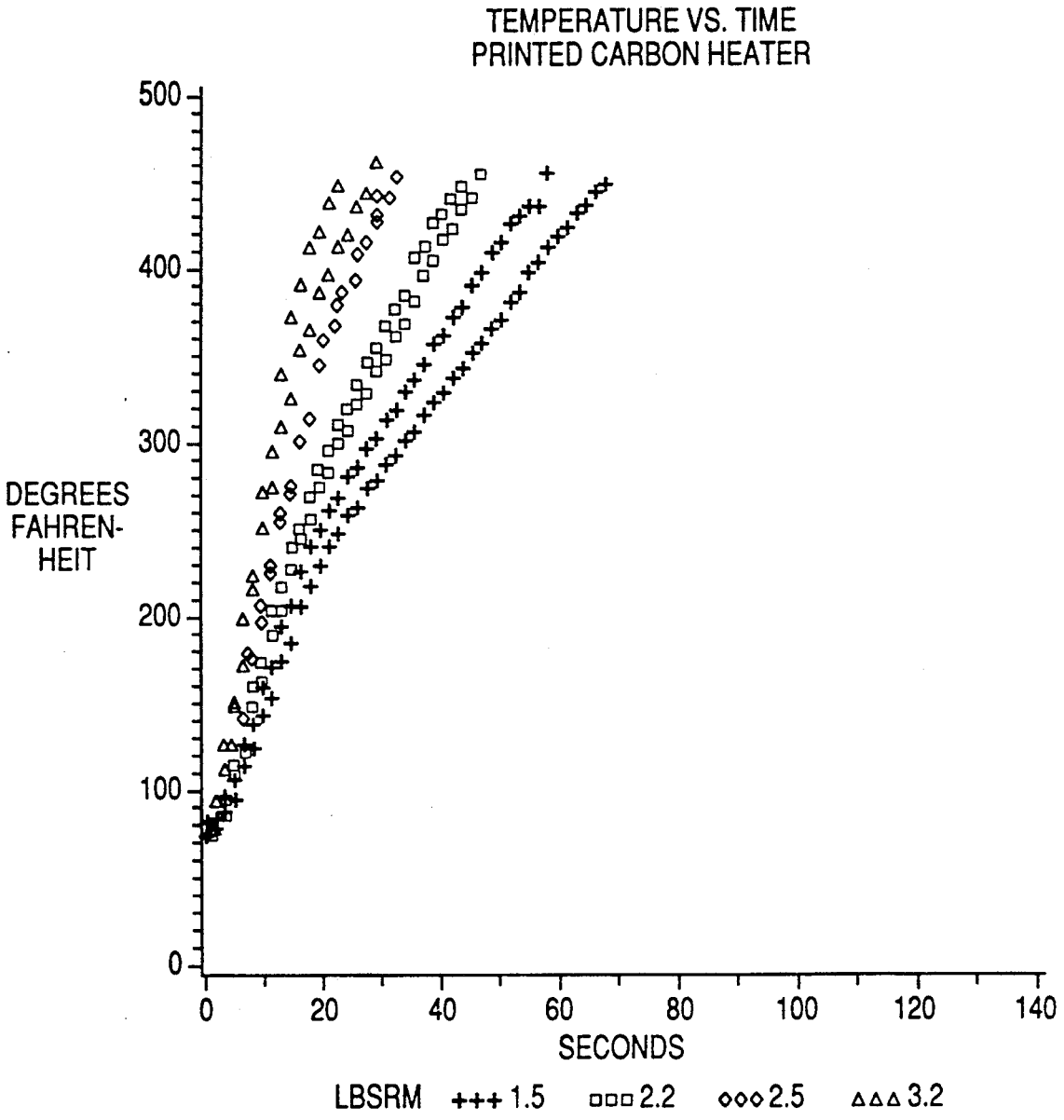

FIG. 6 shows heating curves for a commercial carbon coating. Again heating rate increases with increasing coating weight at the single MRM/binder ratio tested.

Figure 7:
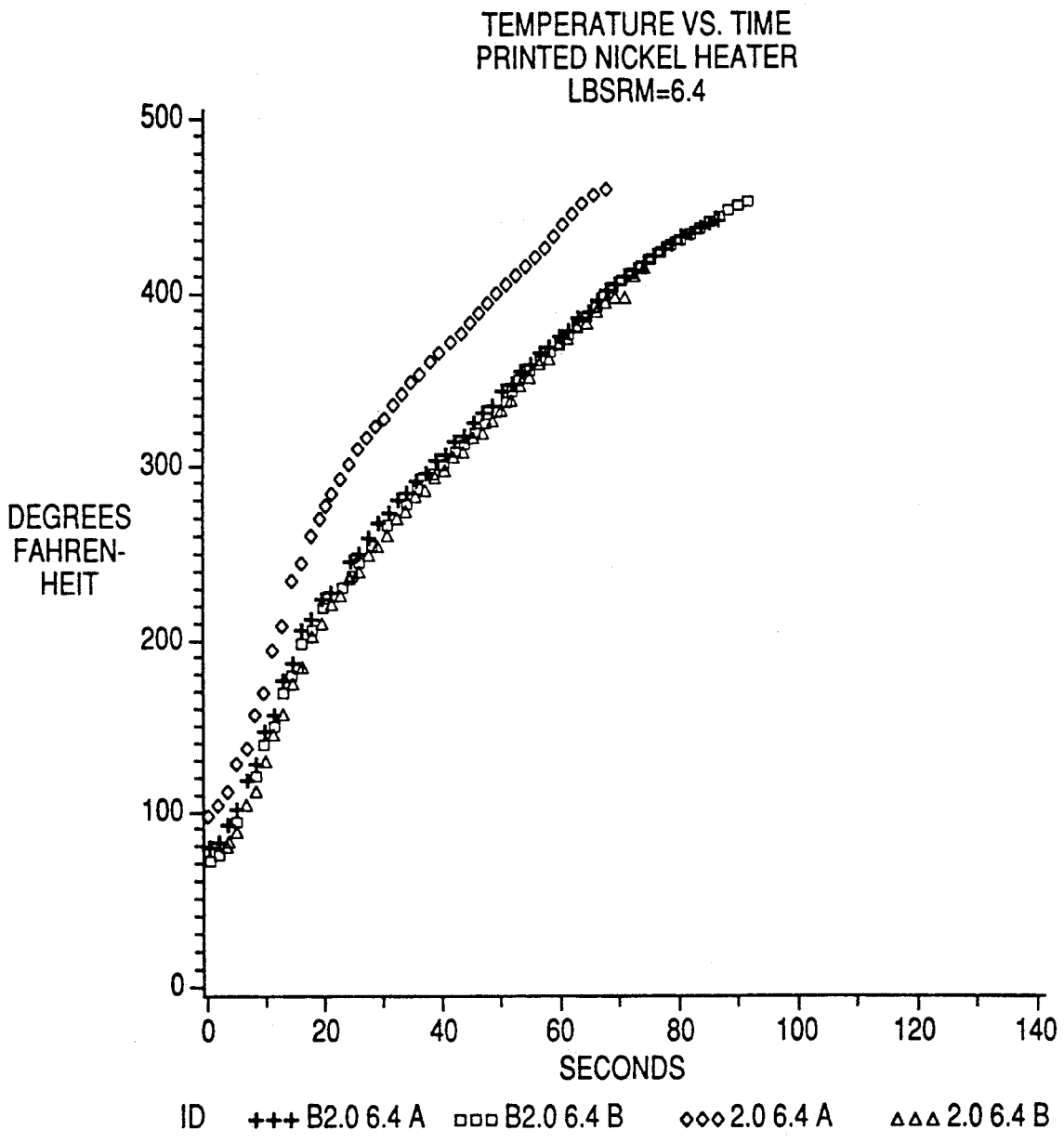
Figure 8:
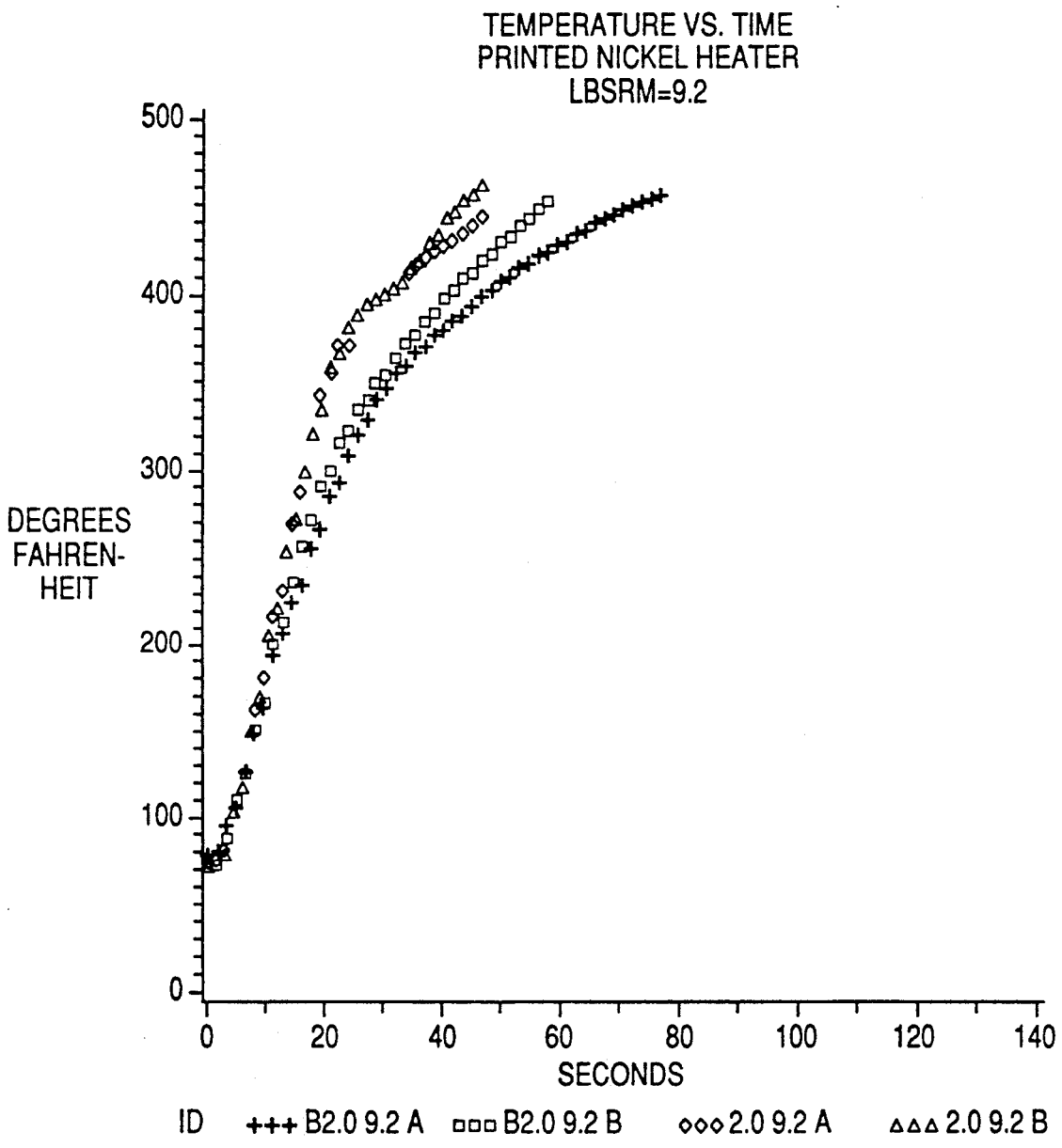

FIGS. 7 and 8 compare heating curves for a nickel formulation printed on two different types of films. Samples are identified at the bottom of the figures. Samples labeled "B" were printed on Bemis film, the others on Dupont Mylar. Both are polyethylene terephthalate (PET) films, but they have different orientations and different heat set temperatures. The Bemis heat set temperature is lower than that of the Mylar. Lower heat set temperatures were expected to result in leveling at lower temperatures. FIG. 7 and 8 indicate that this maybe the case. After initially similar heating rates, the Bemis coated films tend to approach a lower assymptotic temperature than do the Mylar samples. The degree of orientation may also play a role in determining the heater performance.

We claim:

1. A food package for heating or cooking a food product accommodated therein in a microwave oven, the accommodated food product having at least one predetermined portion thereof requiring enhanced heat during the heating or cooking of the product, said package comprising a container for the food product formed of a heat resistant material pervious to the microwaves generated within the oven, said container having a surface area of the material in proximity to the predetermined portion of the accommodated food product, said area having printed directly on the material surface a metallized ink, the latter having a predetermined amount of metal particles suspended in an ink-like substance, whereby when said metallized ink is exposed to generated microwaves, the printed surface area produces the requirement enhanced heat for the one predetermined portion of the accommodated food product.

2. A disposable container for accommodating a food product having at least one predetermined portion requiring enhanced heat when the food product is heated or cooked within a microwave oven, said container being formed of a heat resistant material pervious to microwaves, said material having a surface area on which is directly printed a metallized ink, the latter having a predetermined amount of metal particles suspended in an ink-like substance, said surface area adapted to be in proximity to the predetermined portion of the food product and provide the required enhanced heat therefor when the food product is subjected to the microwaves generated within the oven.

3. A food package containing a microwave reactive material comprising a support material and a microwave interactive coating printed onto a portion of said support material, said support material selected from microwave transparent and thermally stable substrates and said microwave interactive coating comprising metal particles and an ink-like substance that can be used in a printing process.

4. A microwave susceptor package comprising a substrate and a fluid medium which can be coated or selectively printed on said substrate for controlled conversion of microwave radiation to heat without causing arcing during use, said fluid medium comprising:

a heat resistant polymeric binder and a filler comprising metallic and semiconductor substances dispersed in said fluid medium;

wherein said metallic and semiconductor substances are in particulate form, said susceptor having the property that it is heated to a temperature of at least 375° F. within about 4 minutes when exposed to microwave radiation at 700 watts power output.

5. A microwave susceptor coating panel which comprises a heat resistant substrate and a susceptor coated on said substrate;

said susceptor coating comprising a combination of semiconductor particles and metallic particles and a heat resistant polymeric binder wherein said coating converts microwave radiation to heat sufficient to cause heating to a temperature of at least 375° F. within about 4 minutes at a conventional microwave power output level of 700 watts at a frequency of 2450 Megahertz.

* * * * *